US008025107B2

(12) United States Patent
Drivdahl et al.

(10) Patent No.: US 8,025,107 B2
(45) Date of Patent: Sep. 27, 2011

(54) REAMER WITH POLYCRYSTALLINE DIAMOND COMPACT INSERTS

(75) Inventors: Kristian S. Drivdahl, Park City, UT (US); Erik M. Gaugh, Park City, UT (US); Michael D. Rupp, Murray, UT (US)

(73) Assignee: Longyear TM, Inc., South Jordan, UT (US)

( * ) Notice: Subject to any disclaimer, the term of this patent is extended or adjusted under 35 U.S.C. 154(b) by 145 days.

(21) Appl. No.: 12/349,436

(22) Filed: Jan. 6, 2009

(65) Prior Publication Data

US 2009/0283328 A1 Nov. 19, 2009

Related U.S. Application Data

(60) Provisional application No. 61/053,439, filed on May 15, 2008.

(51) Int. Cl.
*E21B 49/00* (2006.01)
*E21B 10/02* (2006.01)
*E21B 17/10* (2006.01)

(52) U.S. Cl. ..... 175/58; 175/325.2; 175/405.1

(58) Field of Classification Search ..... 175/58, 175/405.1, 325.2
See application file for complete search history.

(56) References Cited

U.S. PATENT DOCUMENTS

| | | | | | |
|---|---|---|---|---|---|
| 1,681,675 | A | * | 8/1928 | Miller | 407/49 |
| 1,719,337 | A | * | 7/1929 | Miller | 407/38 |
| 1,907,154 | A | * | 5/1933 | Mitchell | 175/405.1 |
| RE21,068 | E | * | 5/1939 | Mimiller | 407/96 |
| 2,306,798 | A | * | 12/1942 | Benninghoff | 407/38 |
| 2,371,488 | A | | 3/1945 | Williams | |
| 2,419,901 | A | * | 4/1947 | Lake | 175/405.1 |
| 2,708,104 | A | | 5/1955 | McAllister | |
| 2,738,167 | A | | 3/1956 | Williams | |
| 3,054,647 | A | * | 9/1962 | Von Rosenberg | 175/325.4 |
| 3,074,767 | A | | 1/1963 | Von Rosenberg | |
| 3,339,257 | A | * | 9/1967 | Hargreaves et al. | 407/38 |
| 3,535,759 | A | * | 10/1970 | Mueller | 407/38 |
| 3,712,392 | A | * | 1/1973 | Gorgendiere | 175/325.2 |
| 3,833,077 | A | | 9/1974 | Lavallee | |
| 3,848,687 | A | * | 11/1974 | Funakubo | 175/394 |
| 3,882,582 | A | * | 5/1975 | Williams | 407/37 |
| 3,993,368 | A | * | 11/1976 | Jurgens et al. | 175/325.4 |
| 4,277,869 | A | * | 7/1981 | Hartwell | 29/898.01 |
| 4,296,973 | A | * | 10/1981 | Hartwell | 175/325.4 |

(Continued)

FOREIGN PATENT DOCUMENTS

AU 9640891 A * 7/1996

OTHER PUBLICATIONS

International Search Report and Written Opinion dated Jan. 18, 2010 as issued in International Application No. PCT/US2009/043983 filed May 14, 2009.

*Primary Examiner* — Jennifer H Gay

(74) *Attorney, Agent, or Firm* — Workman Nydegger

(57) ABSTRACT

Reamers for use in core-sample drilling include PDC inserts. Such reamers with PDC inserts may be used to maintain borehole diameters, reduce deviation, and/or stabilize drill strings used in core sample drilling. The PDC inserts may be of different sizes and shapes and may be arranged around the reamers in various ways.

28 Claims, 5 Drawing Sheets

U.S. PATENT DOCUMENTS 4,323,131 A * 4/1982 Allee ..... 175/413
4,385,669 A * 5/1983 Knutsen ..... 175/323
4,456,080 A 6/1984 Holbert
4,467,879 A * 8/1984 Burge ..... 175/325.4
4,512,425 A * 4/1985 Brock ..... 175/430
4,662,461 A * 5/1987 Garrett ..... 175/325.4
4,782,903 A * 11/1988 Strange ..... 175/432
4,878,549 A 11/1989 Bennet
5,328,304 A 7/1994 Kress et al.
5,474,143 A 12/1995 Majkovic
5,810,103 A * 9/1998 Torbet ..... 175/413
5,932,508 A 8/1999 Armstrong et al.
6,004,080 A * 12/1999 Qvarth et al. ..... 407/36
6,063,333 A * 5/2000 Dennis ..... 419/6
6,283,234 B1 * 9/2001 Torbet ..... 175/432
6,474,425 B1 * 11/2002 Truax et al. ..... 175/398
6,609,580 B2 8/2003 Beaton
6,880,650 B2 4/2005 Hoffmaster et al.
6,983,811 B2 1/2006 Wardley
7,293,617 B2 11/2007 Beaton
7,533,738 B1 * 5/2009 Hall et al. ..... 175/426
7,600,951 B2 * 10/2009 Van Horssen ..... 407/70
2005/0092526 A1 * 5/2005 Fielder et al. ..... 175/57
2006/0157285 A1 7/2006 Cannon et al.
2006/0157286 A1 7/2006 Pope
2006/0278441 A1 12/2006 Cooley et al.
2007/0029115 A1 2/2007 Beaton
2007/0116530 A1 * 5/2007 Van Horssen ..... 407/111
2009/0283328 A1 * 11/2009 Drivdahl et al. ..... 175/58

* cited by examiner

REAMER WITH POLYCRYSTALLINE DIAMOND COMPACT INSERTS

CROSS-REFERENCE TO RELATED APPLICATIONS

This application claims the benefit of U.S. Provisional Patent Application Ser. No. 61/053,439, filed May 15, 2008, entitled "PDC REAMER," the entire contents of which are incorporated herein by reference.

BACKGROUND OF THE INVENTION

1. The Field of the Invention

This application relates generally to drilling methods and devices used in core drilling. In particular, this application relates to a method and apparatus for using polycrystalline diamond compact in reamers and other core drilling equipment.

2. Background and Related Art

Many drilling processes are currently known and used. One type of drilling process, exploration drilling, often includes retrieving a sample of a desired material from below the surface of the earth. In some processes used in exploration drilling, an open-faced drill bit is attached to the bottom or leading edge of a core barrel for retrieving the desired sample. The core barrel is then attached to a drill string, which is a series of connected drill rods that are assembled section by section as the core barrel moves deeper into the desired subsurface formation. The core barrel is rotated, pushed, and/or vibrated into the formation to obtain a sample of the desired material (often called a core sample). Once the core sample is obtained, the core barrel containing the core sample is retrieved by removing (or tripping out) core barrel. The core sample can then be removed from the core barrel.

Reamers are sometimes used in the drill string to maintain a desired diameter of the borehole and to remove loose or uneven material from the walls of the borehole. Reamers are also sometimes used to maintain drill string alignment in the hole because the reamers have an outer diameter similar to the inner diameter of the hole, while the drill string is usually smaller than the diameter of the hole. Reamers are generally made using a steel tube that can be placed in line with the drill string. The steel tube may have abrasive pads or rings extending around the steel tube to achieve a desired stability for the drill string and/or to maintain the diameter of the borehole.

Maintaining consistent diameter from the top of the borehole to the bottom and clearance between the borehole walls and the drill string can facilitate removing and replacing of the drill string and allow space for drill cuttings clear. Accordingly, the reamer ensures the borehole does not press in on the drill string, which would require additional power to turn the drill string against the surface on significant portions of the borehole. A reamer may also minimize the surface area of the drill string in friction contact with the wall of the borehole while maintaining the lateral support for the drill string and reducing the energy required to turn and advance the drill string. In some applications, damaged or consumed reamers require tripping the entire drill string out for repairs or replacement with a new reamer.

BRIEF SUMMARY OF THE INVENTION

Methods and apparatus for using polycrystalline diamond compact (PDC) inserts in reamers, locking couplings, and adaptor couplings used in core drilling are described in this application. Reamers, adaptor couplings, and locking couplings are sometimes referred to herein collectively as "reamers." The reamers may include one or more PDC inserts arranged in a pattern around a cylindrical body. The reamers may be used in core sample drilling and the PDC inserts may be selected and/or arranged to facilitate a particular purpose. For example, PDC inserts on a reamer may be selected and placed on the reamer to stabilize a drill string during core-sample drilling operations to reduce deviation of the drill string and maintain a constant diameter from top to bottom, all without further enlarging the borehole. Similarly, reamers with a larger diameter than a borehole may be used to enlarge the borehole. In addition to the use of PDC inserts on reamers, they can also be used on locking couplings and adaptor couplings to reduce deviation, stabilize the drill string, and maintain a constant diameter from top to bottom of the borehole.

The PDC inserts can include a polycrystalline diamond layer on a tungsten carbide base. The PDC inserts may be selectively removable from the reamer body to allow replacement of worn or damaged PDC inserts as desired. Similarly, other types of inserts may be used in conjunction with PDC inserts to reduce or increase friction, achieve desired cutting parameters, maintain desired bore hold diameters, maintain drill string alignment, etc. PDC inserts could be supplemented or replaced with tungsten carbide buttons of similar geometry when ground conditions are less abrasive to reduce cost. The PDC inserts may be placed in sites along the reamer body in particular patterns to maximize a desired effect. The PDC inserts may also be manufactured in a variety of shapes, such as planar, circular, domed, pointed, chiseled, square, rectangular, etc, depending on a particular desired use, making a reamer with PDC inserts more adaptable than traditional reamers. The PDC compacts may also be shaped to match the contours of the shank of the reamer.

The reamers with PDC inserts may be manufactured more easily than traditional reamers having many abrasive pads or collars. As well, the reamers with PDC inserts may be reused by replacing the PDC inserts instead of disposing of a reamer with a damaged or worn ring or pad.

Additional features and advantages of example embodiments of the invention will be set forth in the description which follows, and in part will be obvious from the description, or may be learned by the practice of such example embodiments. The features and advantages of such example embodiments may be realized and obtained by means of the instruments and combinations particularly pointed out in the appended claims. These and other features will become more fully apparent from the following description and appended claims, or may be learned by the practice of such example embodiments as set forth hereinafter.

BRIEF DESCRIPTION OF THE DRAWINGS

To further clarify the above and other aspects of the invention, a more particular description of the invention will be rendered by reference to specific embodiments thereof which are disclosed in the appended drawings. It is appreciated that these drawings disclose aspects of only some example embodiments of the invention and are therefore not to be considered limiting of its scope. Embodiments of the invention will be described and explained with additional specificity and detail through the use of the accompanying drawings in which.

DETAILED DESCRIPTION OF THE PREFERRED EMBODIMENTS

Figure 1:
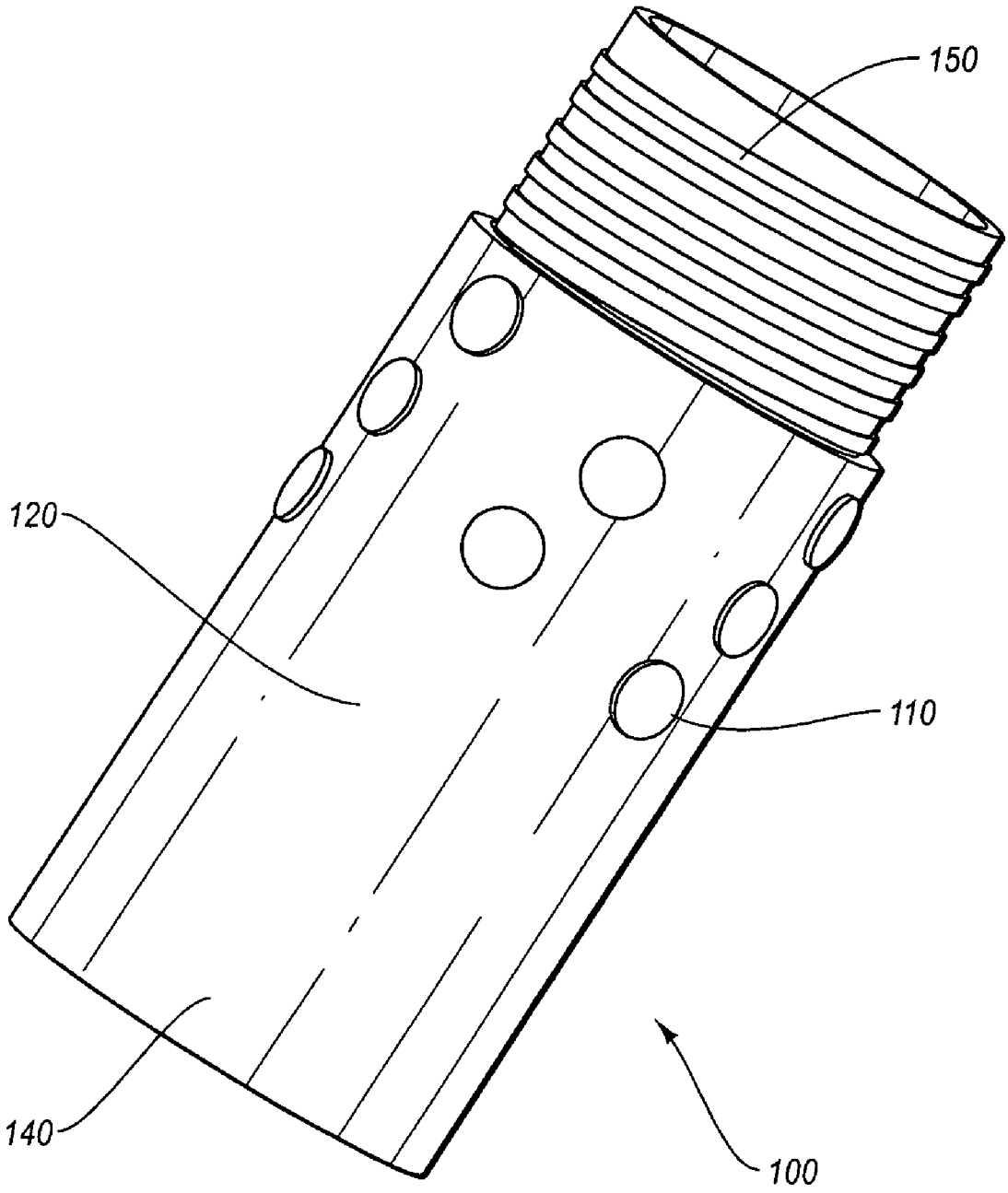
FIG. 1 is a perspective view disclosing aspects of an example of a reamer with PDC inserts.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on core sample operations, the apparatus and associated methods could be equally applied in other drilling processes, such as in conventional borehole drilling, and may be used with any number or varieties of drilling systems, such as rotary drill systems, percussive drill systems, etc.

Some aspects of an example reamer for core-sample exploration drilling: In this FIG. 1, a reamer 100 with Polycrystalline Diamond Compacts inserts 110 is shown. The reamer 100 can have a body 120 with a first connector 140 and a second connector 150. The body 120 can be made from any material that can be used for reaming in core drilling operations, or desired by one of ordinary skill in the art for use in core drilling operations. For example, the body 120 can be made of a variety of grades of steel, tungsten carbide, other alloys, or wear resistant materials.

The body 120 of the reamer 100 can include any shape desired for a particular application. For example, as disclosed in FIG. 1, the body 120 can be generally cylindrical in shape with a generally consistent outer surface. However, one will appreciate that the body 120 can comprise any number of different shapes and surface features as desired for a particular application. For example, the body 120 of the reamer 100 can comprise a number of ridges, channels, teeth, indentations, helical flutes, cutters, etc. In addition, the shape of the body 120 can be generally tapered, oval, concave, rounded, angular, etc. In particular, the body 120 can include any shape or configuration known or used in the art for reamers and couplings.

The first connector 140 and second connector 150 of the reamer 100 as shown in FIG. 1 can be threaded connectors for threaded coupling with different components in a drill string. The first connector 140 can be a female thread that can work cooperatively with a male thread of a first drill rod to couple the reamer 100 to a section of the first drill rod. Similarly, the second connector 150 can be a male thread that can work cooperatively with a female thread of a second drill rod to couple reamer 100 to that second drill rod. In such a configuration, the reamer 100 can be placed in a drill string.

The first connector 140 and second connector 150 can also have any connector type known or used in the art for connecting reamers to drill rods. In some instances, the first connector 140 and the second connector 150 can each be box connectors, pin connectors, threaded connectors, slip connector, or any other connector known in the art to couple reamers into a drill string. The first connector 140 and second connector 150 can be the same or different types of connectors. In a further embodiment, the reamer 100 can be welded to one section of pipe at the first connector 140 and then coupled to another section of pipe using a different type of connection, such as a threaded connection at second connector 150.

As disclosed in FIGS. 2A-2D, the PDC inserts 110 can contain a polycrystalline diamond compact (PCD) layer 114 bonded to a backing substrate (or backing 112). The PDC inserts 110, including the backing 112 and the layer 114, can be made in a variety of shapes and configurations. For example, the PDC inserts 110 can be round, square, rectangular, or any other geometric configuration. The PDC inserts 110 can have any size corresponding with the length, diameter, and wall thickness of the reamer. In some embodiments, the size of the PDC inserts 110 can be between about 0.1 mm and about 50 mm in diameter.

In particular, the PDC layer 114 can itself incorporate a variety of size and shape configurations. Examples of some shapes and configurations for the polycrystalline diamond layer 114 of the PDC inserts 110 can be domed, angled, pointed, or any other desired configuration. For example, the PDC layer 114 can have a substantially planar surface, as shown in FIG. 2A, a domed surface, as shown in FIG. 2B, a pointed, or chiseled center portion, as shown in FIG. 2C, and/or angled surface as shown in FIG. 2D.

Figure 2A:
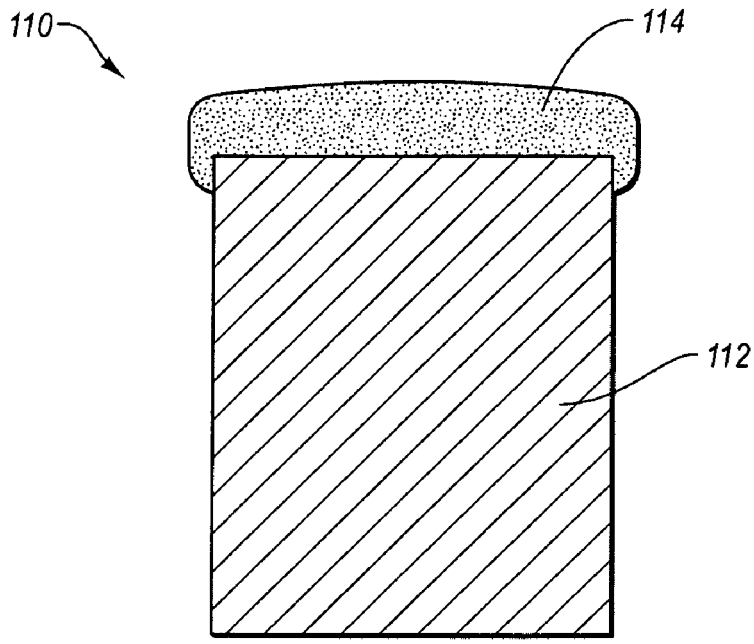
FIG. 2A is a cross-sectional view disclosing aspects of an example PDC insert.

FIG. 2A discloses an example embodiment of a PDC insert 110 with a PDC layer 114 having a substantially planar surface, the layer 114 being coupled to a backing 112. The substantially planar layer 114 can be configured to facilitate contact and abrasion with a surface to be engaged. In one example embodiment, the layer 114 can have a substantially planar surface, rounded edges, and a circular shape. The backing can have any shape or size necessary to correspond with the layer 114 and with sites in the body 120 of a reamer. In particular, in at least one example, the backing can have a generally cylindrical shape with a substantially planar coupling surface. However, one will appreciate that the layer 114 and backing 112 can be reconfigured in further embodiments to incorporate additional configurations. In particular, the layer 114 can have a slightly concave or convex surface, angular edges, and the overall size and shape of the layer 114 and backing 112 can vary as desired.

Figure 2B:
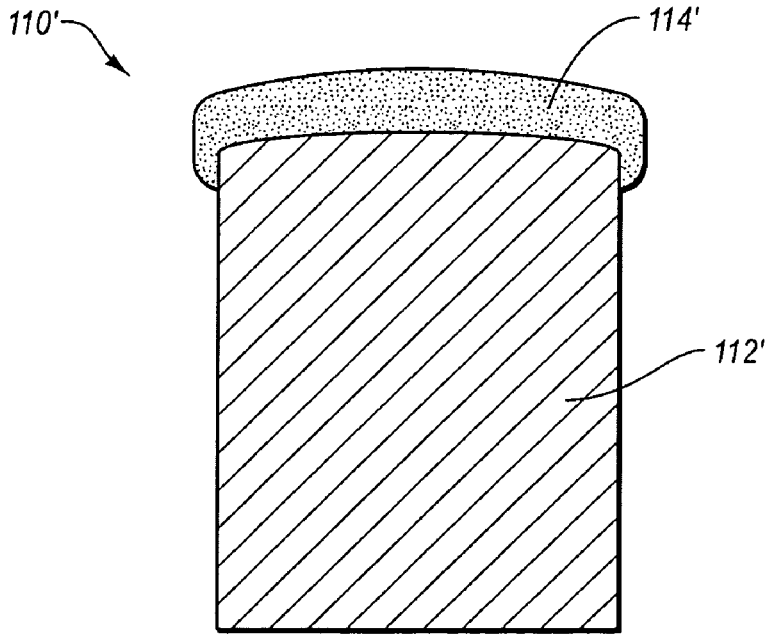
FIGS. 2B is a cross-sectional view disclosing aspects of an example PDC insert.

FIG. 2B discloses an example embodiment of a PDC insert 110' with a domed layer 114' coupled to a backing 112'. The domed layer 114' can be configured to facilitate contact and abrasion with a surface to be engaged. In one example embodiment, the layer 114' of the PDC insert 110' can be generally rounded with the center of the surface of the layer 114 being raised. In other examples, the shape and configuration of the layer 114' can vary as desired for particular applications. In particular, the radius of curvature of the surface of the layer 114', the height of the dome, the roundedness of the edges, and the overall size and shape of the layer 114' and backing 112' can vary as desired in additional example embodiments.

Figure 2C:
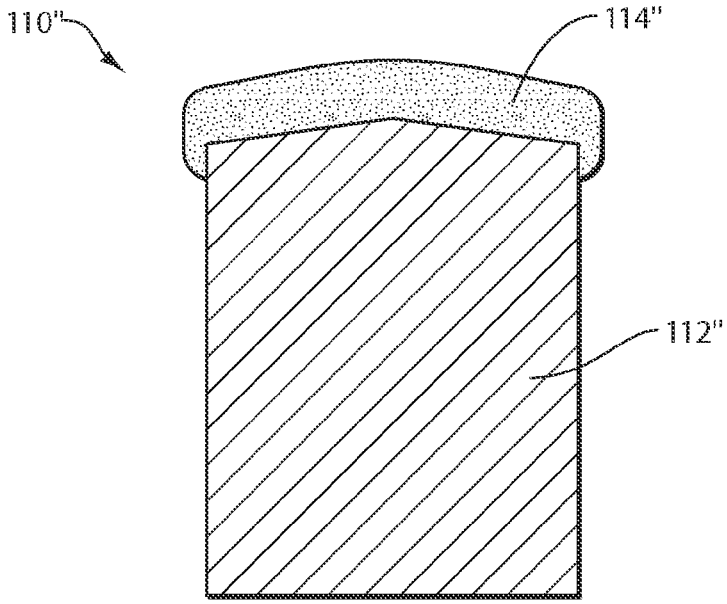
FIGS. 2C is a cross-sectional view disclosing aspects of an example PDC insert.
Figure 2D:
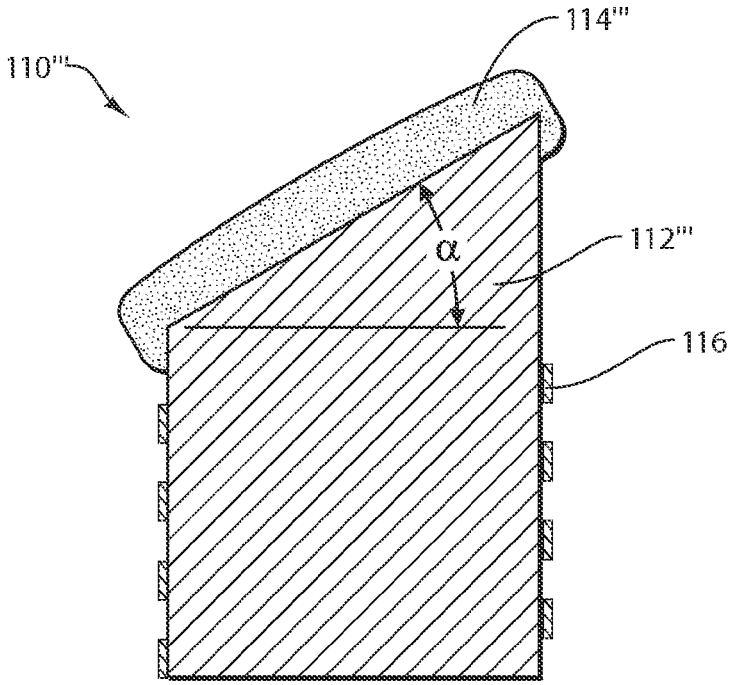
FIGS. 2D is a cross-sectional view disclosing aspects of an example PDC insert.

FIG. 2C discloses an example embodiment of a PDC insert 110" with a generally pointed layer 114" coupled to a backing 112". The generally pointed layer 114" can be configured to facilitate contact and abrasion with a surface to be engaged. In at least one example, the layer 114" of the PDC insert 110" can have a surface that generally tapers from an outer edge to the center, thereby forming a generally pointed center. In other examples, the shape and configuration of the layer 114 can vary as desired for particular applications. In particular, one will appreciate that the height of the point, the angle or pitch of the tapered surface, the roundedness of the edges, and the overall size and shape of the layer 114" and backing 112" can vary as desired in additional examples.

FIG. 2D shows embodiments of a PDC insert 110'" with an angled layer 114'" coupled to a backing 112'". The angled layer 114'" can be configured to facilitate contact and abrasion with a surface to be engaged. The rake angle $\alpha$ of the surface of the layer 114 in FIG. 2D can be any angle desired by one of ordinary skill in the art. For example, in some embodiments the angle $\alpha$ can be between about 0 degrees and about 90 degrees. In further embodiments, the angle $\alpha$ can be between about 0 degrees and about 25 degrees. Furthermore, the direction and orientation of the angel $\alpha$ can vary as desired for different applications. In particular, the angle $\alpha$ can be a front angle or a back angle as desired for a particular application. In addition, the orientation of each PDC insert 110 can vary from one PDC insert 110 to the next.

Referring now to FIGS. 2A-2D, a backing can have a complementary shape to support or otherwise provide a base for the desired shape of the surface of a PDC layer. Some examples of these shapes are depicted in FIGS. 2A-2D, with a base that is substantially circular and a top that is modified to substantially match the layer 114. The backing 112 can be made of any known suitable material for supporting the PDC layer 114. In some example embodiments, the backing can comprise tungsten carbide.

The PDC inserts 110-110'" can be attached to the the body 120 of the reamer 100 using any known technique. In at least one example, the body 120 can include a plurality of sites for PDC inserts 110-110'" that have been prepared for the particular sizes and shapes of the PDC inserts 110-110'". In further examples, the backings 112-112'" of the PDC inserts 110-110'" can be either loosely fit or interference fit (pressed) into one of the sites on the reamer body 120. After insertion, the PDC inserts 110-110'" can then be adjusted to provide a desired outer diameter and orientation of the reamer 100 and can then be mechanically fastened, soldered, brazed, or otherwise bonded into the sites on the body 120 of the reamer 100-100'".

In further examples, PDC inserts can be threaded into sites on a body as shown by threads 116 of FIG. 2D or placed on a body and secured with a set screw or other thread securing techniques. For example, the sites on the body can include internal threading and the backing of the PDC inserts can include complementary external threading. Accordingly, PDC inserts can be threaded into and out of sites on a body in order to easily interchange or replace inserts in a reamer. It will be appreciated that threaded PDC inserts can be further coupled to a body by soldering, brazing, etc.

In at least one example, the PDC inserts 110 can be easily replaced in the reamer 100 when they become worn. For example, when a certain wear level is achieved in the PDC inserts 110, the worn inserts can be removed and replaced with new inserts, extending the life of the reamer, and avoiding the cost and time of replacing the reamers. In some examples, PDC inserts 110 can be unthreaded and replaced, or heated, removed and then replaced with new PDC inserts 110. In some examples, individual PDC inserts 110 can be selectively removed and replaced, depending on the wear patterns and damage to different PDC inserts 110 along the reamer 100. Additionally, some PDC inserts 110 can be replaced with PDC inserts having a different size to achieve a different borehole diameter and/or a different amount of stabilization or friction between the drill string and the borehole.

Figure 3:
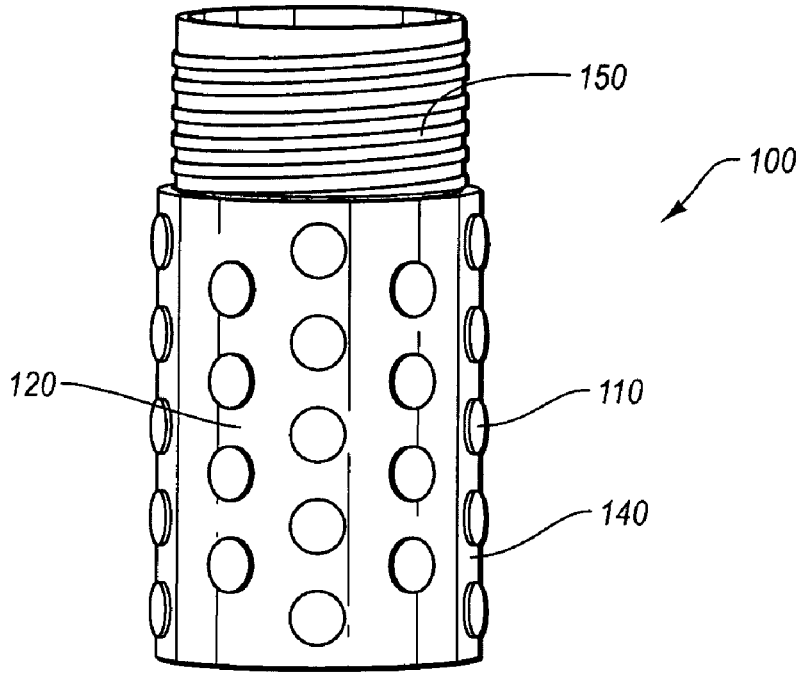
FIG. 3 is a perspective view disclosing aspects of an example reamer including PDC inserts.
Figure 4:
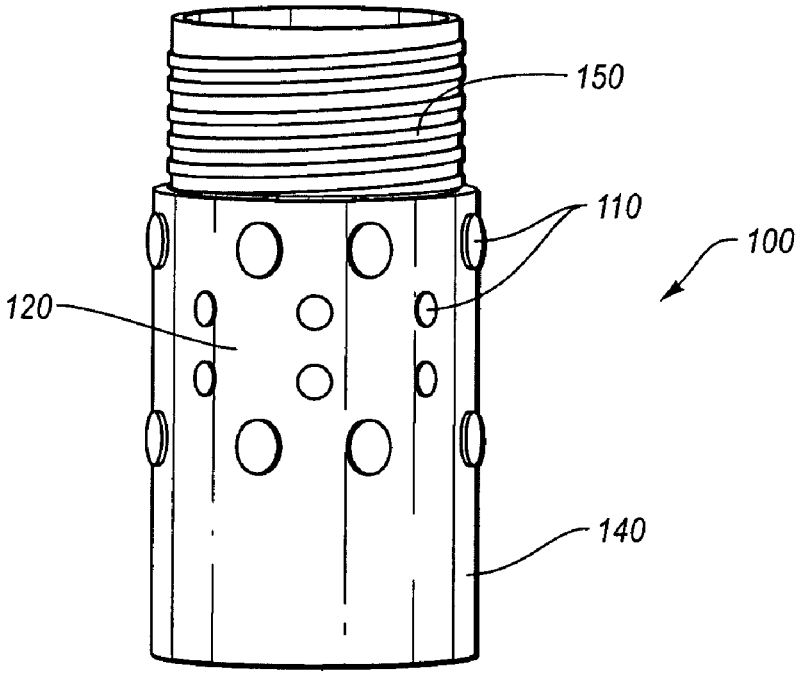
FIG. 4 is a perspective view of an example reamer including PDC inserts.

As shown in FIGS. 3 and 4, PDC inserts 110 can be a variety of sizes and can be arranged around the periphery of the reamer 100 in a variety of ways. In some examples, PDC inserts 110 of one particular size and shape can be in a distributed spiral pattern, with PDC inserts 110 of another size and/or shape being placed in between or otherwise around the first PDC inserts 110. In additional examples, the PDC inserts 110 of differing sizes and shapes can be arranged around the body 120 in a series of rings or columns. Furthermore, the PDC inserts 110 can be arranged in any pattern or variety desired.

In some examples, the reamer 100 can include a varying number of inserts 110. In particular, the reamer 100 can include any number of PDC inserts 110 consistent with the size of the inserts 110 and the size of the body 120. For example, the inserts 110 can extend along the entire surface of the body 120 or can extend along only a portion of the body 120. The body 120 can include a larger number of relatively smaller inserts 110 or can include a smaller number of relatively larger inserts 110, or any combination of large and small inserts 110. Thus, any amount of coverage or design by the PDC inserts 110 around the reamer 100 can be achieved.

The specific PDC inserts 110 used in any specific reamer 100 can be selected to perform a particular task, such as further opening a borehole, stabilizing a drill string in a borehole, minimizing friction of a drill string in a borehole, stabilizing a core barrel assembly in a drill string, maintaining borehole straightness, or any combination of these desired tasks. In some embodiments, PDC inserts 110 can be used in conjunction with other type of inserts, such as ceramic, tungsten carbide, or any other inserts or buttons known in the art.

In some embodiments, the PDC inserts 110 are selected so that a reamer 100 can operate as a stabilizing reaming shell for primarily stabilizing a drill string in a borehole. For example, the reamer 100 can have the length of a standard pipe in a drill string, with PDC inserts positioned along the body 120 of the reamer 100 to stabilize the drill string while minimizing the overall friction between the drill string and a borehole. In other examples, a plurality of reamers 100 can be situated end-to-end in a continuous fashion in a drill string to accomplish stabilization or any other desired function. For example, reamers 100 can increase in outer diameter sequentially along the drill string to enlarge the borehole in small increments as the drill string is advanced into a borehole. In yet a further example, reamers 100 can be dispersed at varying locations along the entire length of a drill string to maintain the borehole and stabilize the entire length of the drill string.

Figure 5:
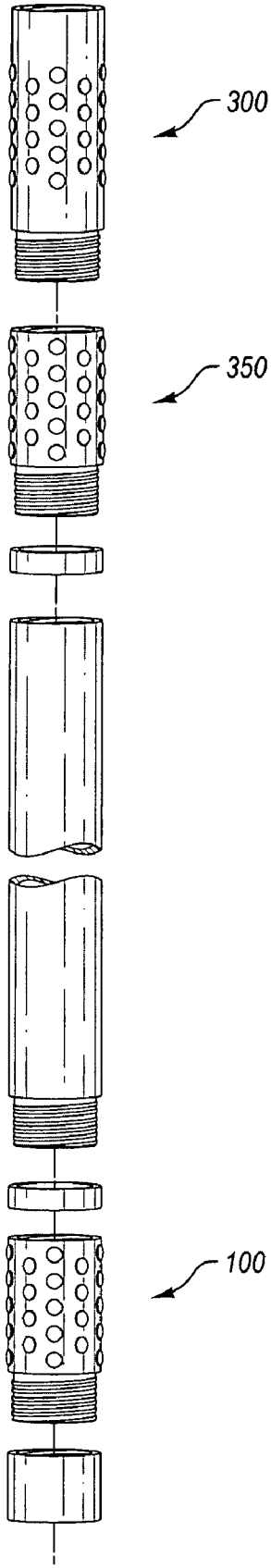
FIG. 5 is an exploded view of an example drill string including reamers, adaptor couplings, and locking couplings with PDC inserts.

As shown in FIG. 5, the PDC design can be extended to additional drilling components. For example, PDC inserts can be coupled to the body of a locking coupling 300. Similarly the adaptor coupling 350 can also include PDC inserts along its outer surface. As a result, the locking coupling 300 and adaptor coupling 350 can assist in stabilizing the hole and keeping the drill string and core barrel assembly properly oriented. In addition, the PDC inserts can be coupled to a variety of additional drilling components used in core sample or other types of drilling.

The use of PDC inserts with reamers in core-sample drilling can allow for less maintenance, increased productivity, better maintenance of borehole diameters, easier manufacturing, on-site maintenance, lower total costs, and longer drill component life. Additionally, the ability to change PDC inserts 110, along with other types of inserts, allows for flexibility in providing and using a drilling component in specific circumstances without the need to purchase additional drilling components or wait for a particular drilling component to ship to a drill site.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A reaming shell for use in core sample drilling comprising:

a cylindrical, steel body used in core sample drilling, the body including:

an upper connector configured to couple an upper end of the body to another drilling component, a lower connector configured to couple a lower end of the body to an additional drilling component, and a length extending from the upper connector to the lower connector, the length having a substantially uniform outer diameter and a consistent outer surface; and a plurality of polycrystalline diamond compact (PDC) inserts secured directly to the body and arranged around the body;

wherein the PDC inserts maintain a diameter of a borehole previously drilled.

2. The reaming shell as recited in claim 1, wherein the PDC inserts are mechanically attached to the body.

3. The reaming shell as recited in claim 2, wherein the PDC inserts are threadably attached to the body.

4. The reaming shell as recited in claim 1, wherein the body includes a plurality of recesses defined therein to receive at least a portion of the PDC inserts.

5. The reaming shell as recited in claim 1, wherein one or more of the upper connector and the lower connector is a threaded connector.

6. The reaming shell as recited in claim 1, wherein one of the PDC inserts differs from another of the PDC inserts in size.

7. The reaming shell as recited in claim 1, wherein each of the PDC inserts includes a polycrystalline diamond compact layer bonded to a backing substrate.

8. The reaming shell as recited in claim 7, wherein the backing substrate comprises steel.

9. The reaming shell as recited in claim 1, wherein one or more of the PDC inserts have a domed outer surface.

10. A core drilling system, comprising a drilling component including:

a cylindrical, steel body configured to be used in core sample drilling, the body having a substantially uniform outer diameter and a consistent outer surface, a connector configured to couple the body to another drilling component;

a first plurality of polycrystalline diamond compact (PDC) inserts attached directly to the body and arranged around the body at a first distance from the connector, at least a second plurality of PDC inserts attached directly to the body and arranged around the body at a second distance from the connector; and a core drill bit.

11. The system as recited in claim 10, wherein the drilling component is a reamer.

12. The system as recited in claim 11, wherein the PDC inserts are mechanically attached to the body.

13. The system as recited in claim 11, wherein the reamer is disposed in a core barrel assembly.

14. The system as recited in claim 11, wherein one of the PDC inserts differs in shape from another of the PDC inserts.

15. The system as recited in claim 11, wherein each of the PDC inserts includes a polycrystalline diamond compact layer bonded to a backing substrate.

16. The system as recited in claim 15, wherein the backing substrate comprises steel.

17. The system as recited in claim 11, wherein one or more of the PDC inserts has a domed outer surface.

18. A drilling method comprising:

securing an upper connector of a reamer to a first drill string component of a drill string;

securing a lower end of the reamer to a second drill string component of the drill string, wherein a cylindrical, steel body with a substantially uniform outer diameter and a consistent outer surface extends from the upper connector to the lower connector;

securing a core drill bit to an end of the drill string;

advancing the drill string into an earthen formation whereby the core drill bit drills a borehole with a diameter, and whereby a plurality of polycrystalline diamond compact (PDC) inserts arranged around, and fastened directly to the body of the reamer, maintain the diameter of the borehole drilled by the core drill bit; and retrieving a core sample.

19. The method as recited in claim 18, further comprising replacing at least one of the PDC inserts with a new PDC insert.

20. The method as recited in claim 18, further comprising unscrewing the at least one PDC insert from the body.

21. The method as recited in claim 18, wherein the drill component is disposed in a core barrel assembly.

22. The method as recited in claim 18, wherein the PDC inserts comprise a polycrystalline diamond layer bonded to a backing substrate.

23. The method as recited in claim 22, wherein the backing substrate comprises a ceramic.

24. The method as recited in claim 23, wherein one or more of the PDC inserts have a domed outer surface.

25. A drilling method comprising:

securing a connector of a steel drilling component to a drill string, the drilling component being cylindrical and having (i) a substantially uniform outer diameter and a consistent outer surface, (ii) a first plurality of polycrystalline diamond compact (PDC) inserts attached to, and arranged around, the outer surface at a first distance from the connector, and (iii) at least a second plurality PDC inserts attached to, and arranged around, the outer surface at a second distance from the connector;

securing a drill bit to an end of the drill string;

advancing the drill string into an earthen formation whereby the drill bit drills a borehole with a diameter, and whereby the first plurality of PDC and the at least a second plurality of PDC inserts maintain the diameter of the borehole drilled by the drill bit;

retrieving a core sample; and un-securing at least one PDC insert from the drilling component.

26. The method as recited in claim 25, wherein the drilling component is an adaptor or locking coupling.

27. The method as recited in claim 25, wherein the drilling component is a reamer.

28. The method as recited in claim 25, wherein the plurality of PDC inserts are configured to be selectively removable from the drilling component.

* * * * *